United States Patent [19]

Hersberger

[11] 4,081,951

[45] Apr. 4, 1978

[54] ELECTRONIC TIMEPIECE

[75] Inventor: Pierre Hersberger, Neuchatel, Switzerland

[73] Assignee: Ebauches SA, Neuchatel, Switzerland

[21] Appl. No.: 752,429

[22] Filed: Dec. 20, 1976

[30] Foreign Application Priority Data

Dec. 23, 1975 Switzerland ..... 16674/75

[51] Int. Cl.[2] ..... G04C 3/00

[52] U.S. Cl. ..... 58/23 R; 58/85.5

[58] Field of Search ..... 58/23 R, 28 R, 4 A, 58/85.5, 23 AC, 23 D

[56] References Cited

U.S. PATENT DOCUMENTS

| | | | |
|---|---|---|---|
| 3,901,022 | 8/1975 | Cleusix et al. | 58/85.5 |
| 3,921,384 | 11/1975 | Moyer | 58/23 R |
| 3,948,035 | 4/1976 | Kusumoto | 58/23 R |
| 3,967,442 | 7/1926 | Bermey | 58/23 R |
| 4,001,553 | 1/1977 | Troutman et al. | 235/92 MS |
| 4,036,006 | 7/1977 | Effenberger et al. | 58/23 R |

*Primary Examiner*—James R. Scott
*Assistant Examiner*—Vit W. Miska
*Attorney, Agent, or Firm*—Imirie, Smiley & Guay

[57] ABSTRACT

An electronic timepiece, wherein an oscillator drives a frequency divider and the output of the frequency divider controls via a driver circuit a display device.

A short-circuit between an output of the driver circuit and a pole of the power supply causes a selector inserted between two of the stages of the frequency divider to feed to the stage following the selector, not as normally, the frequency delivered by the preceeding stage but a higher frequency. This serves for speeding up circuit testing.

4 Claims, 4 Drawing Figures

ELECTRONIC TIMEPIECE

BACKGROUND OF THE INVENTION (1) Field of the Invention

This invention relates generally to electronic timepieces and, more particularly, to a timepiece which comprises an oscillator and a divider chain.

(2) Description of the Prior Art

It is known that in developing an integrated circuit the number of connecting pins should be a minimum. A circuit comprising an oscillator and a divider chain and generating polarised pulses for driving a step motor requires at least six pins under the condition that no pole of the quartz be connected to the power supply. On the other hand, these circuits must be tested after fabrication for ascertaining a faultless operation.

As an example, let us consider a timepiece whose motor receives a pulse every minute: for testing its circuit, its motor must make at least two steps, i.e. two polarised pulses must be waited for. Furthermore, it is not known in which state the divider is when switching on the circuit. In the worst case, one minute elapses before the motor makes its first step. Therefore, a test of such a circuit takes from two to three minutes.

In a production with 9 working hours a day only $9 \times 20 = 180$ circuits can be tested every day. This number evidently is not sufficient.

Of course, it is possible to test several circuits in parallel. If the planned daily production is 1000 pieces, 6 circuits must be tested simultaneously. But the equipment for multiple testing is expensive and often difficult to implement.

Another method for testing such circuits consists in applying a higher frequency than normal to the divider chain or to a part of this chain. This method requires an additional pin, which often cannot be provided because a housing with 7 pins is not standard. On the other hand, the pulse length of the driving pulses are also reduced by speeding up the cycle. Then it is difficult to measure the residual voltage of the output transistors and the pulse duration. Similar problems arise when testing circuits for watches with active or passive display.

SUMMARY OF THE INVENTION

It is an object of the invention to facilitate the testing of an electronic timepiece without adding an additional pin to the integrated circuit and without influencing the test results by their frequency.

The electronic timepiece according to the invention comprises a short-circuit detector controlling a selector inserted in a divider chain and adapted to feed to the following divider stage either the output signal of the preceeding stage or a signal of a higher frequency, when the detector detects a shortcircuit between a pole of the circuit and a pole of the power supply of the timepiece.

Other objects, advantages and novel features of the present invention will become apparent from the following detailed description of the invention when considered in conjunction with the accompanying drawings wherein:

DESCRIPTION OF THE PREFERRED EMBODIMENT

Figure 1:
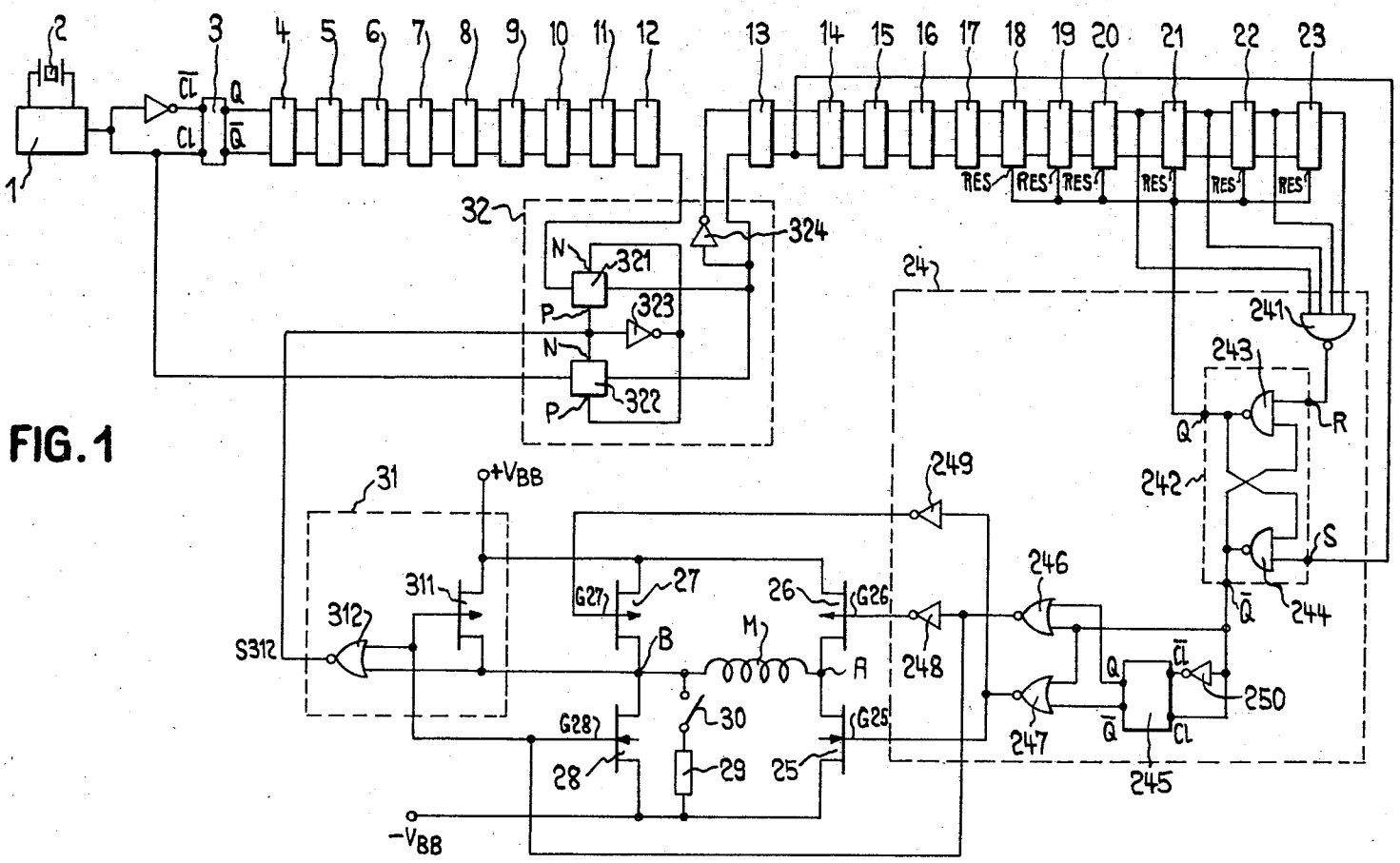
FIG. 1 shows the circuit of a first embodiment of the invention for a timepiece with a step motor.

Referring to FIG. 1 the motor receives a pulse every minute. The timing circuit comprises an oscillator 1, with a quartz crystal 2 generating pulses at the frequency of 32.768 Hz and delivering them to a divider chain composed by 21 flip-flops 3 through 23. The input Cl and $\overline{Cl}$ and the outputs Q and $\overline{Q}$ are indicated for the first flip-flop only; all the flip-flops of the chain have corresponding inputs and outputs. A pulse former 24 receives pulses from the divider chain 3 through 23 for controlling the MOS-transistors 25 to 28, which drive the motor M. These transistors are, in a known manner, connected two and two in series between the poles $+V_{BB}$ and $-V_{BB}$ of the supply battery for the circuit. The sources of the n-type transistors 25 and 28 are connected to the pole $-V_{BB}$, those of the p-type transistors 26 and 27 are connected to the pole $+V_{BB}$. The drains of the transistors 25 and 26 are both connected to the point A, while the drains of the transistors 27 and 28 are connected to point B.

The motor M is represented by its winding and is connected to point A on one side and to point B on the other side. During the circuit test pole B is connected to the pole $-V_{BB}$ of the supply by a switch 30 connected in series with the resistor 29, these two items being provided in the test apparatus.

The pulse former 24 comprises a NAND-gate 241, which is fed by the outputs Q of the flip-flops 21, 22 and 23 and whose output is connected to the input R of the flip-flop 242. This flip-flop is composed by two NAND-gates 243 and 244. The input S of the flip-flop 242 is connected to the output $\overline{Q}$ of the flip-flop 13. The output Q of the flip-flop 242 serves for resetting the flip-flops 18 to 23 through their reset inputs RES, while its output $\overline{Q}$ feeds as well the input Cl of a flip-flop 245, one of the inputs of two NOR-gates 246 and 247 as well as, via an inverter 250, the other input $\overline{Cl}$ of the flip-flop 245. These gates 246 and 247 receive their input signals from the outputs Q and $\overline{Q}$ respectively of the flip-flop 245. The output of the NOR-gate 246 controls as well directly the gate of the transistor 28 of the motor driver circuit as, via an inverter 248, the gate of the transistor 26; the output of the NOR-gate 247 directly controls the gate of the transistor 25 and, via an inverter 249, the gate of the transistor 27.

The timing circuit further comprises the circuit 31, which will be referred to as short-circuit detector and which controls a selector 32 for feeding to the input of flip-flop 13 of the divider chain either the pulses coming from the preceeding stage 12 or from the oscillator 1.

The short-circuit detector 31 comprises a p-type MOS transistor 311 for connecting the point B of the motor driver circuit to the pole $+V_{BB}$. The gate of this transistor 311 is connected to the gate of the control transistor 28 and to one of the inputs of a NOR-gate 312, whose other input is also connected to the point B. The output of the NOR-gate 312 controls two transmission gates 321 and 322. These transmission gates have two control inputs N and P, which receive complementary signals. With the aid of inverter 323, the inputs N and P are controlled so that one gate is enabled and the other one is blocked and vice versa. The transmission gate 321 connects the output $\overline{Q}$ of the flip-flop 12 directly to the input Cl and, via an inverter 324 to the input $\overline{Cl}$ of the flip-flop 13. The transmission gate 322, on the other hand, connects in the same way the output of the oscillator 1 to the inputs of the flip-flop 13.

Figure 2:
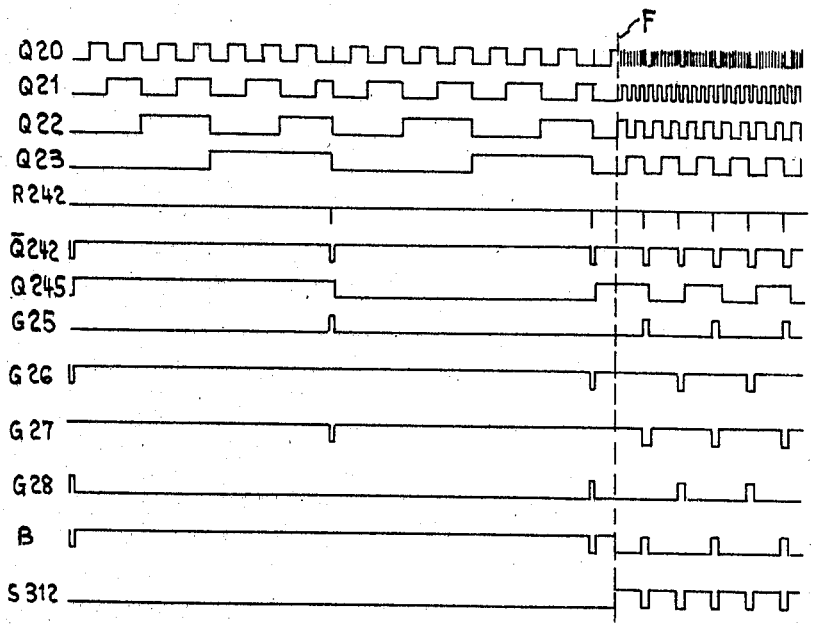
FIG. 2 is useful for illustrating the signals in various points of the circuit shown in FIG. 1.

By a successive division-by-two of the pulse frequency generated by the oscillator 1, a signal of frequency of ⅛ Hz is obtained at the output Q of the flip-flop 20, while the frequency of the signal at the output Q of the flip-flop 21 is 1/16, that at the output of flip-flop 22 is 1/32, and that at the output of flip-flop 23 is 1/64 Hz, which corresponds to a period of 64 seconds. If a period of 60 seconds is wanted, 4 seconds have to be taken off this signal. In FIG. 2 it can be seen that at the moment when all the outputs Q of the stages 20, 21, 22, and 23 (Q20, Q21, Q22, Q23) are on "1" the output of the gate 241 and therefore the input R of the flip-flop 242 (R242) goes to "0" and the output Q of the flip-flop 242 goes to "1", which results in a reset of the stages 18 through 23 and thereby cuts off half of the period of the signal coming from the stage 20, i.e. 4 seconds.

The signal coming the stage 13 and going to the input S of the flip-flop 242 has a frequency of 16 Hz, i.e. a period of 62.5 ms. This signal is on "1", when the output of the NAND-gate 241 goes to "0". Half a period, i.e. 31.25 ms later it goes to "0" and thereby resets flip-flop 242. On FIG. 2 only the signal at the output $\overline{Q}$ ($\overline{Q}$ 242) is represented. Every 60 seconds this signal sets the flip-flop 242, which by its complementary outputs Q and $\overline{Q}$ enables alternatively the NOR-gates 246 and 247. On FIG. 2 again only the signal Q 245 at the output Q of the flip-flop 245 is represented. Furthermore, the FIG. 2 shows the signals at the gates of the transistors 25 to 28: G25, G26, G27 and G28. It can be seen, that the motor pulses are alternatively routed to the transistors 25 and 27 and then to the transistors 26 and 28 for enabling them, so that every minute one current pulse passes through the winding of motor M; the direction of this current is inverted for every pulse.

In normal operation, the switch 30 is open and the state of the output (S312) of the NOR-gate 312 is continually on "0". Between the motor pulses the transistor 311 conducts because the point G28 is on "0" and point B on potential $+V_{BB}$, which corresponds to the logic state "1"; during the motor pulses, which cause the transistors 25 and 27 to conduct, the point B is also held on "1" by the transistor 27; during the motor pulses, which cause the transistors 26 and 28 to conduct, the signal "1" is applied to the gate G28 of the transistor 28, which helds the output S312 on "0". Therefore, the transmission gate 321 remains enabled and the transmission gate 322 remains blocked. The divider stage 13 receives the signal coming from the stage 12.

For checking the operation of the integrated circuit, switch 30 is closed. It has already been mentioned that between the motor pulses transistor 311 is conducting. But if its channel resistance is higher than that of resistor 29, the point B is nevertheless put to "0". In order to fulfill this condition, it is sufficient to give to the channel of transistor 311 a small width and a great length. In between the motor pulses the two inputs of the NOR-gate 312 are on "0" and its output (S 312) on "1". Thus the transmission gate 321 is closed and the transmission gate 322 enabled. Therefore, the stages 13 through 23 receive pulses whose frequency is 1024 times higher than normal. The interval between two motor pulses is about 59 ms. When the transistor 27 is rendered conducting, its channel presents a resistance smaller than the resistor 29, the point B goes to "1", which causes the output of the NOR-gate 312 (S 312) to go to "0" and the stage 13 is during the motor pulse again fed by the pulses coming from stage 12. Thus the duration of that motor pulse is normal (32,25 ms). When the transistor 28 becomes conducting, its gate G 28 goes to "1" and also causes the transition to "0" of the output of the NOR-gate 312. In these two cases the motor pulses retain their normal duration whereas the interval between two motor pulses is considerably reduced.

If two motor pulses (of opposed direction) should pass for testing the circuit the maximum time required is: 59 msec + 31.25 msec + 59 msec + 31.25 msec + 59 msec = ~240 msec.

For clearness sake, in FIG. 2 the time scale is not the same before closing the switch 30, which moment is labelled F, and afterwards.

Figure 3:
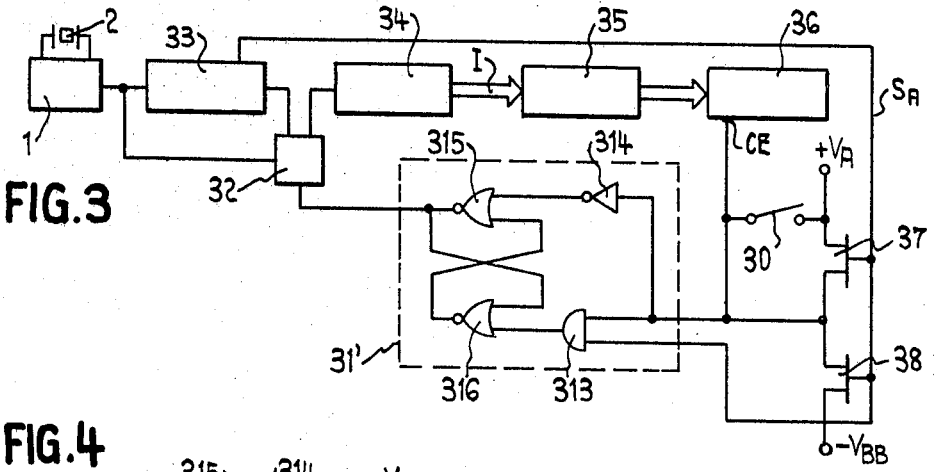
FIG. 3 represents another embodiment of the invention for a watch with active digital display.

On FIG. 3, an embodiment of the invention is represented for a watch having a passive digital display, e.g. by means of a liquid crystal. As in the first case, the watch comprises an oscillator 1 with its crystal 2, a first part 33 of the divider chain followed by a second part 34. These two parts 33 and 34 are connected with each other by the selector 32 composed by the transmission gates already described. The second part 34 of the divider chain comprises the counter dividers which deliver the coded time information I required for display. This information goes to a device 35, which comprises the decoders and interfaces necessary for the control of the display device 36.

In a liquid crystal display device, the counter-electrode CE is common to all display segments. This counter electrode continuously receives a signal $S_A$ coming from the divider chain via an inverter consisting of the transistors 37 and 38. In order to activate a segment, it is sufficient to feed its electrode with the same signal dephased by 180°, the electrode of the nonactivated segments being supplied with the same signal in-phase. The transistors 37 and 38 are very small, for the current delivered by them is relatively small, in the order of a few μA at most. If, for instance, the transistor 38 is conducting and its voltage drop drain-source is 0,3 V while the transistor conducts a current of 3 μA, its channel resitance is:

$$0.3\ V/3\ \mu A = 100\ k\Omega$$

This shows that, even if the voltage drop drain-source is forced to a value of 3 V for instance, the power dissipated by the transistor will not destroy it. For this reason, a switch 30 can be provided for short circuiting the drain of transistor 37, i.e. the counter electrode CE, with the power supply pole $+V_A$. A short-circuit detector 31 is also provided. It comprises an AND-gate 313 which receives the signal fed to the counter electrode CE of the display and the signal $S_A$ coming from the divider chain 33. The output of the AND-gate 313 feeds one of the inputs of a flip-flop composed by the NOR-gates 315 and 316; the second input of this flip-flop is also fed, via an inverter 314, by the signal fed to the counter-electrode CE. The output of the NOR-gate 315 represents the output of the short-circuit detector 31' and controls the selector 32 in the same way as already described. When the switch 30 is open, the signals feeding the AND-gate 313 are always in phase opposition; therefore, the output of this gate is always on "0" while the output of the inverter 314 delivers an inverse signal with respect of that received by the counter electrode, i.e. a series of Zeroes and Ones. The output of the detector 31' is on "0". When the switch 30 is closed, the input of the AND-gate 313 to which it is connected, is on "1". This AND-gate 313 enables the signal $S_A$ to pass while the output of the inverter 314 delivers a potential "0" and the output of the detector 31 delivers a logical potential "1". It is possible to use a similar device for speeding the test of watches having an active digital display, for instance with light emitting diodes (LED). In these watches, the multiplex technique is used, i.e. the digits are not permanently controlled but one is controlled after the other during a short time interval and only when the user asks for it by pressing a button.

Figure 4:
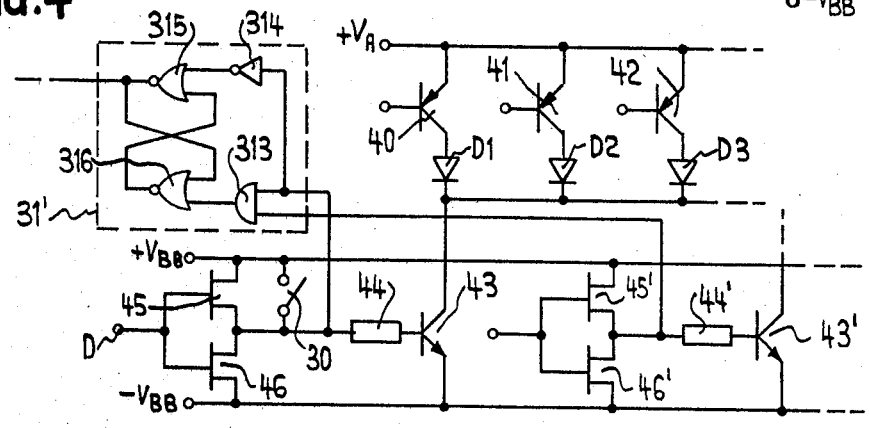
FIG. 4 represents a third embodiment of the invention for a watch having an active digital display.

The control of two of these digits is partially shown on FIG. 4. The light emitting diodes D1, D2, D3, etc., each of which forms a segment of a digit, are series connected with the collector of a transistor 40, 41, 42, etc. These transistors are individually controlled for activating the corresponding segment. The cathodes of the diodes are connected, via a common transistor 43, to the negative power supply pole. A signal applied to point D and inverted by the circuit composed by the p-type MOS-transistor 45 and the n-type MOS-transistor 46 controls, via a resistor 44, the base of the transistor 43, which is the control electrode of the digit. The channel of the transistor 45 is wide, because it conducts the base current of the transistor 43. On the other hand, the channel of the transistor 46 can be very narrow because practically no current passes it. So its resistance is fairly elevated.

A switch 30 can be inserted between the drain of the transistor 45 and the positive pole of the power supply. It is not necessary to provide an additional pin for this purpose because the digit control circuit is implemented on an integrated circuit which is different from that of the rest of the watch circuit. Therefore, access is possible to the connecting point.

During normal operation, the switch 30 is open and the transistor 45 is blocked. When the user wants to read the display and the corresponding digit is activated, the point D goes to "0" and the transistor 45 becomes conducting, which also renders the transistor 43 conducting. The light-emitting diodes can light up on condition that the transistor with which they are in series be also controlled.

The detector 31', which is similar to that in FIG. 3, has its first input connected to the drain of the transistor 46 and its second input connected to the drain of the corresponding transistor 46' of the control circuit of another digit. Normally, even if the display is requested, these two inputs are never simultaneously on "1". Thus the detector output permanently remains on "0".

When the switch 30 is closed the drain of the transistor 46 and, therefore, the first input of the dtector is constantly on "1". When the display is requested, the second input of the detector goes to "1" in the moment when the corresponding digit is activated. The output of the detector goes to "0" with the same effect as above. This state is maintained until the contact 30 is opened again. Then the first input of the detector goes to "0", which resets it to its previous state.

In this embodiment of the invention the contact 30 is placed in the control circuit of one digit. It is obvious that it can also be placed in the control circuit of a segment if the segments are multiplexed.

It has been shown that the invention allows to considerably speed up the test of the integrated circuit and of the finished clockwork without the necessity of providing a single additional pin.

Of course, the resistor 29 and the switch 30 are incorporated in the watch circuit; they should be placed in the test circuit where they can be replaced by appropriate electronic elements.

I claim:

1. An electronic time piece comprising: An oscillator; a frequency divider chain controlled by said oscillator and having a plurality of stages; a display device; a driver circuit for driving said display device under control of the output signals of said frequency divider chain; a short-circuit detector for detecting a short-circuit between an existing pole serving for connection of said driver circuit to said display device and a pole of the power supply; a selector controlled by said short-circuit detector, inserted between two of said divider chain stages and adapted to feed to the stage following the selector either the output signal of the preceeding stage of a higher frequency signal when said detector detects said short circuit.

2. An electronic timepiece according to claim 1, comprising further: a step motor in said display device; a small transistor (311) in said short-circuit detector for connecting an input of the step motor to the other pole of said power supply; a NOR-gate, one input of which is connected to said step motor input, the other input of said NOR-gate being connected to said pole of said driver circuit; and in said selector circuit: a transmission gate controlled by the output of said NOR-gate.

3. An electronic timepiece according to claim 1, wherein the display device is a passive device comprising a counter electrode (CE) which can be short-circuited to a pole of the power supply; the short-circuit detector comprising an inverter (314) whose input is connected to said counter electrode; an AND-gate (313), one input of which also being connected to said counter-electrode, the second input being connected, during normal operation, to a voltage inverted with respect to that applied to the counter electrode; a flip-flop (315, 316), whose inputs are connected to the outputs of the AND-gate (313) and to said inverter (314) respectively and whose output controls the selector (32).

4. An electronic timepiece according to claim 1, wherein the display device is an active electronic device comprising a purality of digit displays, each having a control input, the control input of one of said digit displays being adapted to be short-circuited to a pole of the power supply; the short-circuit detector comprising an inverter (314) connected to the control input of said one of said digit displays; an AND-gate (313), one input of which is also connected to said one of said control inputs and whose other input receives the control signal of another digit; and a flip-flop (315, 316), whose inputs are connected to the outputs of the AND-gate (313) and of the inverter (314) respectively, and whose output controls the selector (32).

* * * * *

UNITED STATES PATENT OFFICE

CERTIFICATE OF CORRECTION

PATENT NO. : 4,081,951

DATED : April 4, 1978

INVENTOR(S) : PIERRE HERSBERGER

It is certified that error appears in the above-identified patent and that said Letters Patent are hereby corrected as shown below:

Claim 1, line 24, "of" should be --or--.

Claim 4, line 51, "purality" should be --plurality--.

Signed and Sealed this

*Fourth* Day of *March 1980*

[SEAL]

*Attest:*

SIDNEY A. DIAMOND

*Attesting Officer*

*Commissioner of Patents and Trademarks*